US010258174B2

(12) United States Patent
Huerta

(10) Patent No.: US 10,258,174 B2
(45) Date of Patent: Apr. 16, 2019

(54) FULL LENGTH LIGHT UP BLING MIRROR

(71) Applicant: Monique Huerta, Fontana, CA (US)

(72) Inventor: Monique Huerta, Fontana, CA (US)

( * ) Notice: Subject to any disclaimer, the term of this patent is extended or adjusted under 35 U.S.C. 154(b) by 0 days.

(21) Appl. No.: 16/008,182

(22) Filed: Jun. 14, 2018

(65) Prior Publication Data

US 2018/0360239 A1 Dec. 20, 2018

Related U.S. Application Data

(60) Provisional application No. 62/519,206, filed on Jun. 14, 2017.

(51) Int. Cl.

| | |
|---|---|
| ***F21V 33/00*** | (2006.01) |
| ***A47G 1/02*** | (2006.01) |
| ***A47G 1/06*** | (2006.01) |
| *F21Y 115/10* | (2016.01) |
| *F21W 131/302* | (2006.01) |

(52) U.S. Cl.

CPC ..... *A47G 1/02* (2013.01); *A47G 1/0622* (2013.01); *F21V 33/004* (2013.01); *F21W 2131/302* (2013.01); *F21Y 2115/10* (2016.08)

(58) Field of Classification Search

None

See application file for complete search history.

(56) References Cited

U.S. PATENT DOCUMENTS

2002/0154379 A1* 10/2002 Tonar ..... B60Q 1/2665 359/267

2009/0116244 A1* 5/2009 Hsiao ..... H05K 1/0274 362/297

* cited by examiner

*Primary Examiner* — Vip Patel

(74) *Attorney, Agent, or Firm* — The Iwashko Law Firm, PLLC; Lev Ivan Gabriel Iwashko

(57) ABSTRACT

A full length light up bling mirror, including a mirror to provide a reflection, and a border to surround an entire edge of the mirror, the border including a plurality of crystals disposed on a front surface of the border, a plurality of light emitting diodes (LEDs) disposed within the plurality of crystals, and a CPU to control the plurality of LEDs to change at least one of colors and lighting settings.

4 Claims, 1 Drawing Sheet

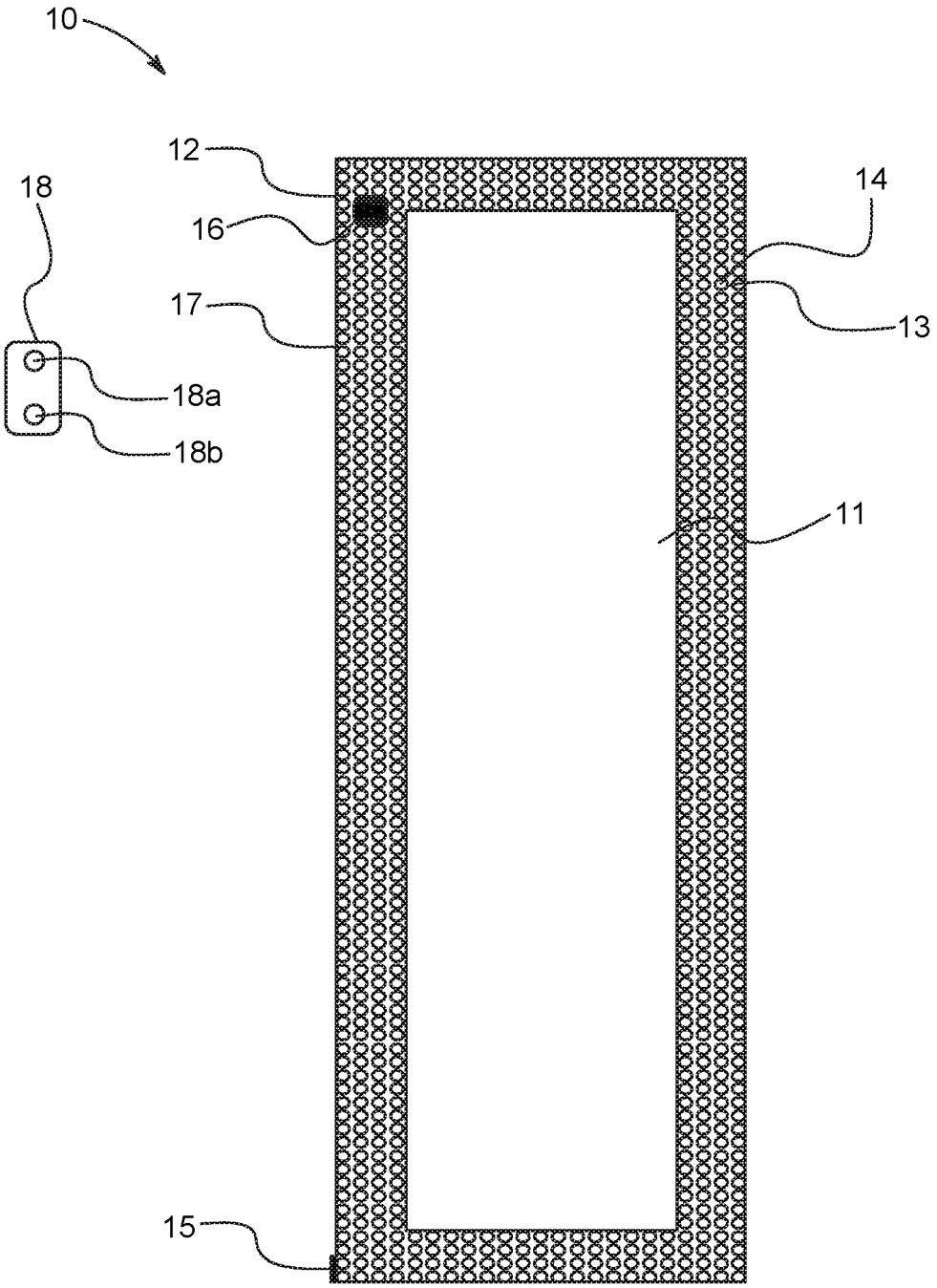
10
12
18
16
14
17
13
18a
18b
11
15

FULL LENGTH LIGHT UP BLING MIRROR

CROSS-REFERENCE TO RELATED APPLICATIONS

This application claims priority under 35 USC § 120 from U.S. Provisional Application No. 62/519,206, filed on Jun. 14, 2017, in the United Stated Patent and Trademark Office, the disclosure of which is incorporated herein in its entirety by reference.

BACKGROUND

1. Field

This invention relates generally to a full length mirror and, more particularly, to a full length light up bling mirror.

2. Description of the Prior Art

Many individuals utilize mirrors in order to assess and correct their appearance prior to exiting their homes. However, traditional mirrors found in homes are often too small and only afford views from above the shoulders, and even full length mirrors leave much to be desired, as they do not enhance the reflection in any way, and poor lighting within the room can make it difficult to fully view the impact of one's ensemble.

Therefore, there is a need for a novel novelty-type mirror.

SUMMARY

The present general inventive concept provides a full length light up bling mirror.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a full length light up bling mirror, including a mirror to provide a reflection, and a border to surround an entire edge of the mirror, the border including a plurality of crystals disposed on a front surface of the border, a plurality of light emitting diodes (LEDs) disposed within the plurality of crystals, and a CPU to control the plurality of LEDs to change at least one of colors and lighting settings.

The full length light up bling mirror may further include a remote control to control the CPU to provide power to the plurality of LEDs and to change the at least one of the colors and the lighting settings of the plurality of LEDs.

The full length light up bling mirror may further include a sensor disposed on the surface of the border and connected to the CPU to receive signals from the remote control to provide the power to the plurality of the LEDs.

The sensor may receive signals from the remote control to control the CPU to change the at least one of the colors and the lighting settings of the plurality of LEDs.

BRIEF DESCRIPTION OF THE DRAWINGS

These and/or other features and utilities of the present generally inventive concept will become apparent and more readily appreciated from the following description of the embodiments, taken in conjunction with the accompanying drawings of which:

FIG. 1 illustrates a full length light up bling mirror, according to an exemplary embodiment of the present general inventive concept.

DETAILED DESCRIPTION

Various example embodiments (a.k.a., exemplary embodiments) will now be described more fully with reference to the accompanying drawings in which some example embodiments are illustrated. In the FIGURE, the thicknesses of lines, layers and/or regions may be exaggerated for clarity.

Accordingly, while example embodiments are capable of various modifications and alternative forms, embodiments thereof are shown by way of example in the FIGURE and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

FIG. 1 illustrates a full length light up bling mirror 10, according to an exemplary embodiment of the present general inventive concept.

Referring now to FIG. 1, the full length light up bling mirror 10 may include a mirror 11, and a border 12.

The mirror 11 may be any type of reflective surface to provide reflection.

The border 12 may surround an entire edge of the mirror 11.

The border 12 may include a plurality of crystals 13, a plurality of light emitting diodes (LEDs) 14, an outlet 15, a sensor 16, and a CPU 17, but is not limited thereto.

The plurality of crystals 13 and the plurality of light emitting diodes (LEDs) 14 may be disposed on a front surface of the border 12.

Each of the plurality of LEDs 14 may be behind or within each of the plurality of crystals 13, such that the plurality of crystals 13 reflect and enhance light emitted from the plurality of LEDs 14.

The outlet 15 may be attached to a cord (not illustrated) to provide power to the plurality of LEDs 14 and the CPU 17.

The sensor 16 may be connected to the CPU 17, which may be disposed within the border 12, in order to help control the plurality of LEDs 14.

A remote control 18 may be provided to control the plurality of LEDs 14.

The remote control 18 may include a power button 18*a* to turn on and/or off the plurality of LEDs 14.

The remote control 18 may also include a light changing button 18*b* to change colors and/or lighting settings/modes of the plurality of LEDs 14. The plurality of LEDs 14 may be any color, including, but not limited to, red, orange, yellow, green, blue, indigo, violet, black, and white, and the lighting settings/modes may include strobe, constant, patterned, etc.

When the power button 18*a* is pressed, the sensor 16 may receive a signal from the remote control 18 to turn the CPU 17 on and/or off. When the power button 18*b* is pressed, the sensor 16 may receive signals from the remote control 18, such that the CPU 17 actually controls the plurality of LEDs 14 to change the colors and/or the lighting settings/modes.

Specifically, the sensor 16 may be disposed on the surface of the border 12 and may be connected to the CPU 17 to receive signals from the remote control 18 to provide the power to the plurality of the LEDs 14.

The sensor 16 may also receive signals from the remote control 18 to control the CPU 17 to change the at least one of the colors and the lighting settings of the plurality of LEDs 14.

The main purpose of the full length light up bling mirror 10 is to provide consumers with an extravagant appearance. Ingenious, practical and useful, the full length light up bling mirror 10 is an innovative alternative to conventional methods of glamorizing one's appearance.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A full length light up bling mirror, comprising:
- a mirror to provide a reflection; and
- a border to surround an entire edge of the mirror, the border comprising:
  - a plurality of crystals disposed on a front surface of the border,
  - a plurality of light emitting diodes (LEDs) disposed within the plurality of crystals, and
  - a CPU to control the plurality of LEDs to change at least one of colors and lighting settings.

2. The full length light up bling mirror of claim 1, further comprising:
- a remote control to control the CPU to provide power to the plurality of LEDs and to change the at least one of the colors and the lighting settings of the plurality of LEDs.

3. The full length light up bling mirror of claim 2, further comprising:
- a sensor disposed on the surface of the border and connected to the CPU to receive signals from the remote control to provide the power to the plurality of the LEDs.

4. The full length light up bling mirror of claim 3, wherein the sensor receives signals from the remote control to control the CPU to change the at least one of the colors and the lighting settings of the plurality of LEDs.

* * * * *